US005614343A

United States Patent [19]

Nozomi et al.

[11] Patent Number: 5,614,343

[45] Date of Patent: Mar. 25, 1997

[54] ELECTROPHOTOGRAPHIC COPYING PROCESS FOR REVERSAL DEVELOPMENT

[75] Inventors: Mamoru Nozomi, Yokohama; Masayuki Hiroi, Odawara; Itaru Ogawa, Yokohama, all of Japan

[73] Assignee: Mitsubishi Chemical Corporation, Tokyo, Japan

[21] Appl. No.: 505,655

[22] Filed: Jul. 21, 1995

[30] Foreign Application Priority Data

Jul. 25, 1994 [JP] Japan ..... 6-172663

[51] Int. Cl.[6] ..... G03G 21/08

[52] U.S. Cl. ..... 430/100; 430/125

[58] Field of Search ..... 430/58, 100, 125

[56] References Cited

U.S. PATENT DOCUMENTS 4,469,767 9/1984 Kitamura et al. ..... 430/55
4,471,039 9/1984 Borsenberger et al. ..... 430/58
4,557,868 12/1985 Page et al. ..... 260/245
4,725,519 2/1988 Suzuki et al. ..... 430/58
5,001,027 3/1991 Otsuka et al. ..... 430/31

FOREIGN PATENT DOCUMENTS 2-233769 9/1990 Japan .

*Primary Examiner*—John Goodrow
*Attorney, Agent, or Firm*—Oblon, Spivak, McClelland, Maier & Neustadt, P.C.

[57] ABSTRACT

The disclosure describes an electrophotographic copying process for reversal development using a laminate-type electrophotographic photoreceptor having laminated on an electroconductive support a charge generation layer containing a phthalocyanine compound and a charge transport layer, and capable of forming plural copies of image, comprising at least charging step, image exposing step, developing step, transferring step and charge erasing step by light, wherein the charge erasure by light is not conducted in image formation by the first rotation of photoreceptor and is conducted in image formation by the second and succeeding rotations of photoreceptor.

9 Claims, 2 Drawing Sheets

ELECTROPHOTOGRAPHIC COPYING PROCESS FOR REVERSAL DEVELOPMENT

BACKGROUND OF THE INVENTION

The present invention relates to an electrophotographic copying process for reversal development using a laminate-type electrophotographic photoreceptor containing a specific compound.

Electrophotography invented by C. F. Carlson is now used widely not only in the field of copying machines but also in the field of printers and facsimiles because of the capability of forming images showing excellent instantaneity, high-quality and retentivity.

This electrophotographic process is basically composed of an image forming process comprising the steps of uniformly charging the photoreceptor surface, forming a static latent image by image exposure corresponding to manuscript, developing the latent image with toner, transferring the toner image to a transfer paper (transfer may be conducted through an intermediate transfer) and fixing, and an initialization process for repeated use of the photoreceptor, that is, a charge erasure process comprising steps of cleaning for removing the residual developer and erasing residual electrical charges on the photoreceptor surface.

As the photoreceptor of electrophotography, there have conventionally been used inorganic photoconductive materials such as selenium, arsenic-selenium alloy, cadmium sulfide, zinc oxide and the like, but recently photoreceptors using organic photoconductive materials having advantages such as presenting no pollution problems, facilitativity of film formation, facilitativity of production of the photoconductor, etc., have been developed.

Particularly, laminate-type photoreceptors having a charge generation layer and a charge transport layer laminated on a substrate are mass-produced commercially because of their advantages such as a high sensitivity and a wide selectivity for the material, which facilitates the preparation of photoreceptors with a high safety, a high productivity of the coating layer, and a relatively low production cost.

On the other hand, rapid progress has been made recently in digitization technology for image formation for obtaining images with higher quality and for enabling memorizing and free editing of input images. Hitherto, a digital image formation has been possible only with certain devices such as laser printers and LED printers, which are output devices of word processors or personal computers, and parts of color laser copiers, but digitization is rapidly prevailing in the field of ordinary copying machines which have mostly been designed for analog image formation.

For carrying out such digital image formation, when a computer information is directly used, an electrical signal of such information is converted to an optical signal, or when information is input from a manuscript, such information is read as optical information. The obtained optical signal is converted to the digital electrical signal, and then the obtained signal is again converted to the optical signal and input to the photoreceptor. In either case, the information is input as optical signal to the photoreceptor, and laser light or LED light is principally used for the optical input of such digital signal. Input light most popularly used at present is near infrared light with an oscillation wavelength of 780 nm or 660 nm, or long-wavelength light with a wavelength close thereto. The primary requirement for a photoreceptor used for digital image formation is that it has enough sensitivity to such near infrared light and long-wavelength light, and a variety of materials have been studied for such photoreceptor. Phthalocyanine compounds have been most earnestly studied, with some of such compounds having already been put to practical use, as many of these compounds are relatively easy to synthesize and have a high sensitivity to long-wavelength light.

For instance, a photoreceptor using titanyl phthalocyanine is disclosed in U.S. Pat. No. 4,725,519, and use of β-indium phthalocyanine is proposed in U.S. Pat. No. 4,471,039. Also, Japanese Patent Application Laid-open (Kokai) No. 2-233769 discloses a photoreceptor using χ-type metal-free phthalocyanine, and in U.S. Pat. No. 4,557,868 the use of vanadyl oxyphthalocyanine is proposed as a photoreceptor material.

On the other hand, for digital image formation, there is prevalently employed a so-called reversal developing system in which toner is deposited at the portion exposed to light for the purpose of making effective utilization of light or increasing resolving power. In the reversal developing process, the dark potential portion appears as a white area and the bright potential portion as a black area (image portion).

As mentioned above, the photoreceptor, after image development, is subjected to initialization for image formation. In this step, the charge erasure is conducted either by a method utilizing AC corona discharge or light. The method utilizing light, namely charge erasure by light, is preferred as the apparatus used for this method is simple and no harmful gas such as ozone is produced unlike in the method utilizing an AC corona discharge.

However, in the case where the present inventors conducted the image formation using a laminate-type photoreceptor containing a phthalocyanine compound in the charge generation layer according to a reversal development copying process including the step of charge erasure by light, a phenomenon was observed in which the image formed by the process of the first rotation cycle of the photoreceptor exhibited excessive background fouling and no good image could be obtained. When the copying process was conducted a plural number of times to form plural copies of an image, the second image prepared on the second rotation cycle of the photoreceptor, although showing slight background staining, was nevertheless substantially acceptable, and for each succeeding rotation of the photoreceptor, almost good images were obtained.

According to the investigation of this phenomenon by measuring surface potential of the photoreceptor, it has been found that the surface potential in the development stage of the first rotation cycle is substantially below the prescribed level. In the second rotation cycle, only a slightly diminished surface potential was observed, and in the third and succeeding rotation cycles of the photoreceptor, the surface potential was retained at the prescribed level.

When the same measurement was conducted after allowing the apparatus to stand for a while, a similar phenomenon was observed in the first rotation cycle. Further, when the same measurement was conducted after using the photoreceptor repeatedly to bring it into a considerably fatigued state, it was found that the lowering of the surface potential was further enlarged in the first rotation cycle.

The laminate-type photoreceptors using a phthalocyanine compound in the charge generation layer are widely used, and the above phenomenon has been observed in use of any of these photoreceptors, although there was a slight difference in degree among them. The fact that the above phenomenon has not been observed, in the case of the laminate-type photoreceptors using an azo dye in the charge generation layer, indicates that the above phenomenon is specific to the laminate-type photoreceptors using the phthalocyanine compound.

The mechanism of this phenomenon is not clear, but various investigations point to the following facts for accounting for the above phenomenon.

In the operation for charge erasure by light in an ordinary electrophotographic process, the carrier is formed in excess in the charge generation layer of the laminate-type photoreceptor to neutralize the residual potential, thereby erasing the electrical charge. Here, when electron traps are present in the charge generation layer, the previously formed carrier is temporarily captured by such traps, and if such carrier still remains in the ensuing charging step, a part thereof is released which causes a lowering of the charging potential. In the second and succeeding rotations, since the electron traps are almost plugged up, the release of the carrier in the next charging step is restricted, thereby lessening the lowering of the charging potential.

It is also considered that when allowed to stand, the electron holes captured by the traps are heat-relaxed, thereby allowing the electron traps to be restored to their initial free state which causes a lowering of the potential. Enlargement of potential decrement observed when the photoreceptor is fatigued is considered attributable to gradual increase of the amount of electron traps in the charge generation layer due to fatigue.

As explained above, when a laminate-type photoreceptor using a phthalocyanine compound in the charge generation layer is employed in a reversal developing electrophotographic process including a step for charge erasure by light, the above-mentioned problem exists potentially. In the past, such problem has been countered by employing a system in which the process of the first rotation of photoreceptor, where the charging voltage lowers, is not used for image formation (that is, photoreceptor is rotated idly), and the image formation is conducted in the processes of the second and succeeding rotations where the charging voltage is stabilized. This system has been employed for the reasons that in a reversal development-type printer with a relatively low copying speed (such as less than 10 copies per minute with A4 size paper), the above phenomenon does not occur conspicuously because the charge controlling capacity of the charger has enough and to spare, and that no problem arises even when the first rotation of photoreceptor is made idle since time is required for transfer of data from a computer, etc. However, in case the manuscript is copied directly as in a digital copier with a high copying speed, the incorporation of such idle rotation becomes a great obstacle to high-speed operation, and thus it has been ardently desired to develop a system in which the image formation can be conducted from the first rotation of photoreceptor.

In view of the above, as a result of the present inventors' extensive studies on techniques dispensing with such wasteful idle rotation when a laminate-type photoreceptor using a phthalocyanine compound in the charge generation layer is employed in a reversal developing electrophotographic copying process including a step for charge erasure by light, it has been found that by employing a system in which charge erasure by light is not conducted in the image formation in the process of the first rotation of photoreceptor but is practiced in the second and succeeding rotations, it is possible to obtain high-quality images continuously without making idle the first rotation. The present invention has been achieved on the basis of the above finding.

SUMMARY OF THE INVENTION

In an aspect of the present invention, there is provided an electrophotographic copying process for reversal development using a laminate-type electrophotographic photoreceptor having a charge generation layer containing a phthalocyanine compound and a charge transport layer on an electroconductive substrate, and capable of forming plural copies of image, comprising the steps of electrically charging, image-exposing, developing, transferring and charge-erasing by light, wherein the first rotation of the photoreceptor, an image is formed without conducting the charge erasure by light, but in the second and succeeding rotations, an image formation is performed by conducting the charge erasure by light.

DETAILED DESCRIPTION OF THE INVENTION

Figure 1:
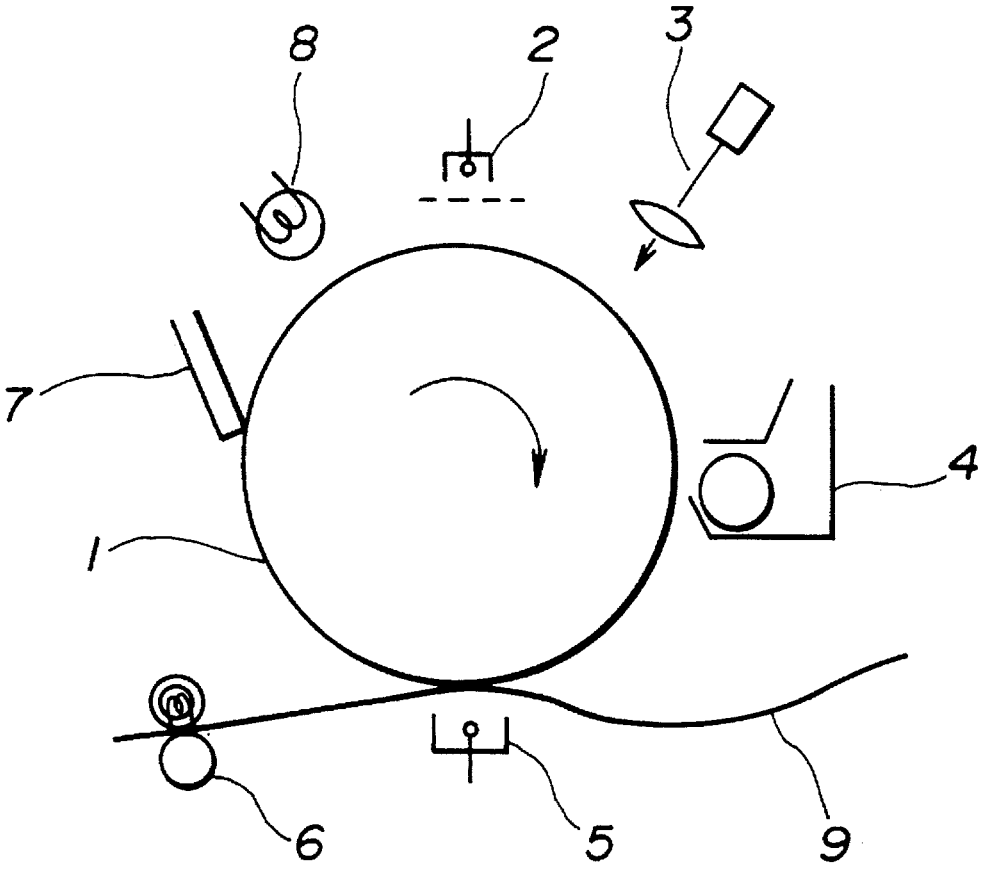
FIG. 1 is a schematic illustration of a layout of an electrophotographic copying process.

The laminate-type photoreceptor used in the present invention is provided on an electroconductive support. The electroconductive support is composed of a metal material such as aluminum, aluminum alloys, stainless steel, copper, nickel or the like, polyester films, paper or the like having aluminum deposited thereon. The electroconductive support is usually of a cylindrical or endless belt-like configuration.

A barrier layer used commonly may be disposed between the said electroconductive support and photoconductive layer.

As the barrier layer, for example, an anodized film of aluminum, an inorganic layer composed of aluminum oxide, aluminum hydroxide or the like, or an organic layer composed of polyvinyl alcohol, casein, polyvinylpyrrolidone, polyacrylic acid, celluloses, gelatin, starch, polyurethane, polyimide, polyamide or the like may be used. The barrier layer may contain electroconductive or semiconductive fine particles of a metal such as aluminum, copper, tin, zinc, titanium or the like, or a metal oxide.

The photosensitive layer of the laminate-type photoreceptor of the present invention is basically composed of a charge generation layer and a charge transport layer. In the present invention, phthalocyanine compounds are used as a charge generation material in the charge generation layer. Examples of the phthalocyanine compounds usable in the present invention include non-metallic phthalocyanines, phthalocyanines coordinated with metals such as copper, indium chloride, potassium chloride, tin, titanyl, zinc, vanadium and the like, oxides or chlorides of the said metals. In the charge generation layer may be contained a charge generating material(s) other than phthalocyanines for changing a spectral sensitivity or for improving electrical properties such as charging characteristics, residual potential, etc. Examples of such additive materials are selenium and its alloys, arsenic-selenium, cadminum sulfide, zinc oxide, other inorganic photoconductive materials, azo pigment, quinacridone, polycyclicquinone, pyrylium salts, thiapyrilium salts, indigo, thioindigo, anthoanthrone, pyranthrone, cyanin and the like.

The charge generation layer may be a dispersing layer of fine particles (with an average particle size of preferably not more than 1 μm, more preferably not more than 0.5 μm, even more preferably not more than 0.3 μm) of a charge generating material such as mentioned above which have been bound with a binder resin such as polyester, polyvinyl acetate, polyacrylic ester, polymethacrylic ester, polycarbonate, polyvinyl acetoacetal, polyvinyl propional, polyvinylbutyral, phenoxy resin, epoxy resin, urethane resin, cellulose ester, cellulose ether or the like.

The amount of the fine particles of the charge generating material used in the charge generation layer is in the range of 30 to 500 parts by weight based on 100 parts by weight of the binder resin. The thickness of the charge generation layer is usually 0.1 to 2 μm, preferably 0.15 to 0.8 μm. The charge generation layer may contain additives such as leveling agent, antioxidant, sensitizer, etc., for improving coating properties. The charge generation layer may be a depositing film of a charge generating material such as mentioned above.

The charge transport materials usable for forming the charge transport layer in the photoreceptor according to the present invention include electron attractive materials such as 2,4,7-trinitrofluorenone, tetracyanoquinodimethane and the like, and electron donative materials, for example, heterocyclic compounds such as carbazole, indole, imidazole, oxazole, pyrazole, oxadiazole, pyrazoline, thiadiazole, etc., aniline derivatives, hydrazone compounds, aromatic amine derivatives, stilbene derivatives, and polymers having the groups composed of these compounds in the main chain or side chain. The charge transport material such as mentioned above are bound to a binder resin to form a charge transport layer.

The binder resins usable for forming the charge transport layer include vinyl polymers such as polymethyl methacrylate, polystyrene, polyvinyl chloride, copolymers thereof, polycarbonates, polyesters, polyester carbonates, polysulfones, polyimides, phenoxy resins, epoxy resins, silicone resins, and partially crosslinked cured products of these resins.

The amount of the charge transport material in the charge transport layer is 30 to 200 parts by weight, preferably 40 to 150 parts by weight based on 100 parts by weight of the binder resin. The thickness of the charge transport layer is 5 to 50 μm, preferably 10 to 45 μm. In the charge transport layer may be contained additives such as plasticizer, antioxidant, ultraviolet absorber, leveling agent, etc., for improving the film-forming properties, flexibility, coating properties, etc.

The photoreceptor of the present invention may be provided with an overcoat layer principally composed of a known thermoplastic or thermosetting polymers. Usually, the charge transport layer is formed on the charge generation layer, but this may be reversed. These layers can be formed by known methods such as successive application of coating solutions prepared by dissolving or dispersing in a solvent the materials to be contained in the layers.

The thus formed laminate-type photoreceptor is used in the electrophotographic process for reversal development according to the present invention. The present electrophotographic process comprises at least steps of electrically charging, image-exposing, developing, transferring and charge erasing by light, and the commonly employed techniques can be applied for these steps.

The electrical charging can be accomplished by non-contact charging with Corotoron or Scorotoron which makes use of corona discharge, or contact charging using a conductive roller or brush. Usually the photoreceptor is charged to a voltage in the range of −300 V to −1,000 V by charging means such as mentioned above.

As a light source for image exposure, semiconductor laser light, LED light, liquid crystal shutter light and the like can be used.

The development can be performed by a commonly employed contact or non-contact development method with a magnetic or non-magnetic one-component or two-component developer.

For transfer, a method utilizing corona discharge or a method using a transfer roll can be used.

As light applied in the step for charge erasure by light, there can be used white light from a tungsten lamp, etc. or red light from an LED light source, etc. The light output is set so that the intensity of light applied in the said step become usually about 2 to 30 times volume (dose) of light at which the photoreceptor shows half-decay exposing sensitivity (viz. the volume of light necessary for reducing by half the potential after charging).

The electrophotographic copying process according to the present invention is carried out with a process disposition such as illustrated in FIG. 1.

In FIG. 1 showing the basic system for carrying out the copying process of the present invention, numeral 1 designates an OPC photoreceptor, numeral 2 designates an electrical charger, numeral 3 designates an image exposure means, numeral 4 designates a developing device, numeral 5 designates a transfer means, numeral 6 designates a fixing means, numeral 7 designates a cleaner, and numeral 8 designates a means for erasing charge by light.

First, the surface of photoreceptor 1 is uniformly charged by electrical charging means 2 in a dark place and light is applied to the area other than the image portion by image-exposing means 3 to eliminate the charge at the light-exposed portion, thereby forming a static latent image at the image portion. Then a toner composed of fine colored particles electrically charged to the opposite polarity to the static latent image is deposited on the latent image and developed into a visible image by developing means 4. Then recording paper 9 is placed on the toner image, the electric charge of the opposite polarity to that of the toner is given to the recording paper from the backside thereof by transferring means 5 and the toner image is transferred to recording paper 9 by the electrostatic force. The transferred toner image is fixed by fixing means 6. Meanwhile, residual toner on the surface of OPC photoreceptor 1 after the transfer operation is removed by cleaning means 7 and the charge on the latent image is erased by charge erasing means 8.

Figure 2:
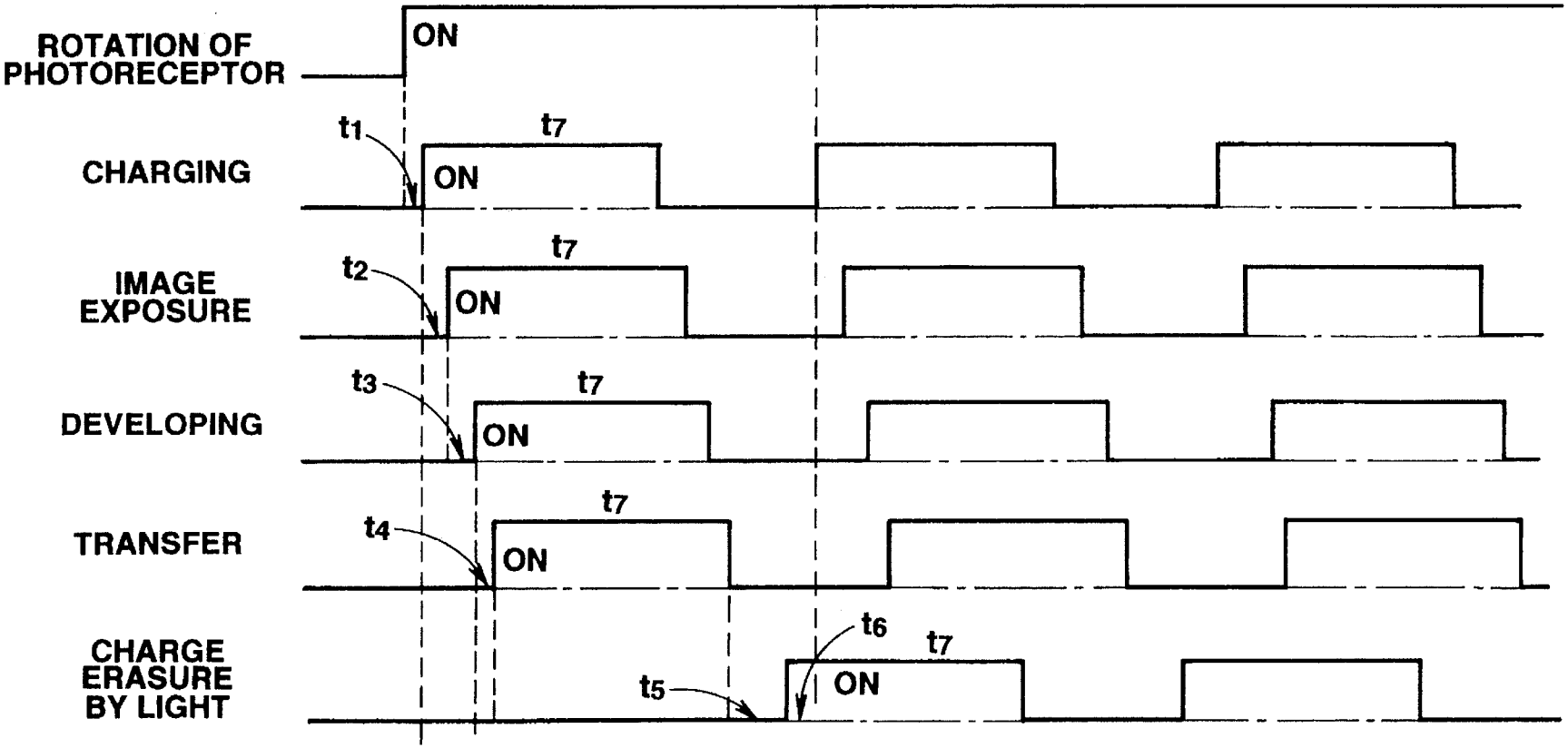
FIG. 2 is a process time chart for the copying process according to the present invention.

The charge erasure by light is not performed in image formation by first rotation of the cylindrical or endless belt-like photoreceptor, it is performed in image formation by the second and succeeding rotations of photoreceptor. Specifically, such charge erasure can be easily accomplished by programming the respective steps according to a time chart such as shown in FIG. 2. By the way, the FIG. 2 illustrates a program of the respective steps in the case where a piece of image is formed during one rotation of the OPC photoreceptor.

When OPC photoreceptor 1 begins to rotate, there takes place the initial (first) charging step with a time lag of $t_1$. Then, the image-exposing step begins with a time delay of $t_2$ from the starting of the charging step, followed by the developing step with a time delay of $t_3$ from the starting of the image-exposing step and the transferring step with a time delay of $t_4$ from the starting of the developing step. The charging step, image-exposing step, developing step and transferring step are each performed for a period of $t_7$ with rotation of the photoreceptor 1. After the lapse of a time $t_5$ from the end of the transferring step, first charge-erasing step by light begins. Then, second charging step starts with a time delay of $t_6$ from the starting of charge-erasing step. With second rotation of photoreceptor 1, there is carried out another run of image-forming process in the same way as the image forming process with first rotation of photoreceptor described above. Thus, the total time of one unit of the image-forming process is the sum of $t_2+t_3+t_4+t_5+t_6+t_7$. In the process of the present invention, therefore, it is essential to make programming so that the first charge-erasing step starts just after the lapse of the period of t1 plus one unit ($t_2+t_3+t_4+t_5+t_6+t_7$) from start of rotation of the photoreceptor. As stated, although the program of the respective steps has been explained according to the FIG. 2, when the photoreceptor is plurally rotated for forming a piece of image using the cylindrical or endless belt-like photoreceptor having a small diameter, the steps other than exposing step may be operated successively without discontinuing after the electrophotographic copying process is performed once.

In the present specification, "first rotation" of the photoreceptor means the initial rotation of the photoreceptor on every push of the start button. Usually the photoreceptor rotates at an equal speed throughout the operation of forming plural copies of image (either in case plural copies are obtained from one manuscript or in case plural manuscripts are copied).

Usually, when the charging in the next run of the process is conducted without charge erasure, the charged state becomes nonuniform since exposure pattern in the proceeding process remains. In the case of normal developing system, the charge erasure is essential, since a residual image corresponding to the exposure pattern in the preceding process is formed at the charged portion. However, in the case of the reversal developing system, since such nonuniform charged portion becomes a white area and undergoes no development, it may give substantially no influence on the image formed in the next process. Therefore, if a relatively uniform charged state is produced in the next charging step, the charge erasure becomes substantially unnecessary. Actually, the image forming systems involving no charge erasure are employed in low-speed reversal development-type printers. However, in case where a shortage of charging performance takes place when the process speed is high (for example, the photoreceptor peripheral speed is not less than 100 mm/sec, especially not less than 150 mm/sec, and the copying speed is not less than 20 copy/sec with A4-size paper), uniformity of charging is lowered unless charge erasure by light is conducted, and there takes place a "memory phenomenon", i.e. a phenomenon that the exposure pattern in the preceding process remains. In the present invention, such a memory phenomenon is scarcely allowed to take place since charge erasure by light is conducted in the processes of the second and succeeding rotations of the photoreceptor.

When the image formation is carried out with the electrophotographic copying process according to the present invention, it is possible to dispense with idle rotation and thus to perform image formation from the first rotation of photoreceptor, so that fast printing of the first copy is made possible. The copying process of the present invention can be applied not only to ordinary laser and LED printers but also to various types of transmitting and copying devices such as electrophotographic facsimiles, digital copiers, full color copying machines, etc. The system of the present invention is particularly useful for high-speed electrophotographic process.

EXAMPLES

The present invention is described in further detail below with reference to the examples and comparative examples. These examples are, however, presented for illustrative purposes only and should not be construed as limiting the scope of the invention.

Preparation Example 1

On an aluminum cylinder with an outer diameter of 80 mm, a 0.5 μm-thick charge generation layer containing 10 parts by weight of titanyl phthalocyanine dispersed in 5 parts by weight of polyvinyl butyral resin and a 20 μm-thick charge transport layer mainly composed of 70 parts by weight of N-methylcarbazole-9-carbaldehydediphenylhydrazone and 100 parts by weight of polycarbonate were laminated to form a photoreceptor A.

Preparation Example 2

On an aluminum cylinder with an outer diameter of 80 mm, a 0.5 μm-thick charge generation layer composed of a deposit of titanyl phthalocyanine and a 20 μm-thick charge transport layer mainly composed of 85 parts by weight of 4-dibenzylamino-2-methylbenzaldehydediphenylhydrazone and 100 parts by weight of polycarbonate were laminated to make a photoreceptor B.

Preparation Example 3

On an aluminum cylinder with an outer diameter of 80 mm, a 0.4 μm-thick charge generation layer having 10 parts by weight of χ-type metal-free phthalocyanine dispersed in 10 parts by weight of acrylic resin and a 20 μm-thick charge transport layer mainly composed of 10 parts by weight of 4-dibenzylamino-2-methylbenzaldehydediphenylhydrazone, 80 parts by weight of 1,1-diphenyl-4,4-bis(4-diethylaminophenyl)butadiene-1,3 and 100 parts by weight of polycarbonate were laminated to make a photoreceptor C.

Preparation Example 4

On an aluminum cylinder with an outer diameter of 80 mm, a 0.5 μm-thick charge generation layer containing 10 parts by weight of bisazo pigment dispersed in 10 parts by weight of polyvinyl butyral and a 20 μm-thick charge transport layer mainly composed of 100 parts by weight of pyrenecarbaldehydediphenylhydrazone and 100 parts by weight of polycarbonate were laminated to make a comparative photoreceptor D.

Example 1

With the angle made by the charge eraser and the charger set at 85° and the angle made by the charger and the surface potential measuring probe set at 110°, each of the above photoreceptors was rotated at a peripheral speed of 84 mm/sec and placed under the Scorotoron charging conditions, so that the photoreceptor surface would be charged to −700 V.

LED red light was used as charge-erasing light, and the charge erasure/charging process was repeated cyclically while monitoring surface potential of the photoreceptor in each run of process. Tables 1 and 2 show surface potentials in each rotation of photoreceptor in case charge erasure by light was conducted from before charging in the first rotation of the photoreceptor and in case charge erasure was not conducted in the first rotation of the photoreceptor but conducted in the second and succeeding rotations of the photoreceptor.

The Table 1 shows surface potential in each rotation, in case where the charge erasure was conducted from before charging in the first rotation. The Table 2 shows surface potential in each rotation, in case charge erasure was conducted in the second and succeeding rotations.

TABLE 1

| Photo- | Surface potential in each rotation (−V) | | | | |
|---|---|---|---|---|---|
| receptor | 1 | 2 | 3 | 5 | 10 |
| A | 660 | 690 | 700 | 700 | 700 |
| B | 640 | 690 | 700 | 700 | 700 |
| C | 610 | 680 | 695 | 700 | 700 |
| D | 690 | 695 | 700 | 700 | 700 |

TABLE 2

| Photo- | Surface potential in each rotation (−V) | | | | |
|---|---|---|---|---|---|
| receptor | 1 | 2 | 3 | 5 | 10 |
| A | 695 | 700 | 700 | 700 | 700 |
| B | 695 | 700 | 700 | 700 | 700 |
| C | 695 | 700 | 700 | 700 | 700 |
| D | 690 | 700 | 700 | 700 | 700 |

As is seen from the above results, when a photoreceptor containing a phthalocyanine compound is used in the process including the step of charge erasure by light from the first rotation of photoreceptor, the lowering of potential in the first rotation is very large. On the other hand, when the charge erasure is not conducted in the first rotation but is performed in the second and succeeding rotations of the photoreceptor as in the present invention, there can be obtained a stable state of charging from the beginning.

In the case of the comparative photoreceptor D containing no phthalocyanine compound in the charge generation layer, the charge is stable in either of the above patterns of process, which indicates that the above-described effect of the charge erasure by light on the state of charging in the first rotation is a phenomenon peculiar to a photoreceptor containing a phthalocyanine compound.

Example 2

Photoreceptor A made in Preparation Example 1 was set in a copying machine remodeled to a reversal developing system with a peripheral speed of 190 mm/sec, and the image obtained from the process in which charge erasure was conducted from the beginning and the image obtained from the process in which charge erasure was not conducted in the first rotation but performed in the second and succeeding rotations were evaluated.

Operation of this copying machine was programmed to run according to the time chart:

The period ($t_6$) between the starting of the charge erasure and the starting of the charging was 0.15 sec; the period ($t_2$) between the starting of the charging and the starting of the image exposure was 0.12 sec; the period ($t_3$) between the starting of the image exposure and the starting of the development was 0.21 sec; the period ($t_4$) between the starting of the development and the starting of the transfer was 0.33 sec.

As the results show, in case charge erasure was conducted from the beginning, the image of the first copy was fogged entirely and no good image could be obtained. In case where charge erasure was omitted in the first rotation but conducted in the second and succeeding rotations, there could be obtained the good images with little fogging from the first copy.

What is claimed is:

1. An electrophotographic copying process which is capable of forming plural copies of an image for reversal development employing a laminated electrophotographic photoreceptor, comprising the steps of at least:

(a) charging said laminated electrophotographic photoreceptor having a charge generating layer containing a phthalocyanine compound and a charge transport layer laminated on an electroconductive support, said photographic photoreceptor being rotated in any give photocopying cycle;

(b) exposing the photoreceptor to an image;

(c) developing an image on the photoreceptor; and (d) transferring said developed image to a receiving medium, the steps (a), (b), (c) and (d) being conducted in the stated order;

(e) charge erasing the photoreceptor by light, wherein the step (e) of charge erasure by light is not conducted in the image forming process of the first rotation cycle of the photoreceptor, but is conducted in the image forming process of the second and succeeding rotation cycles of the photoreceptor.

2. An electrophotographic copying process according to claim 1, wherein image formation for plural copies is carried out by rotating the photoreceptor at a uniform speed.

3. An electrophotographic copying process according to claim 1, wherein image formation is carried out with the peripheral speed of the photoreceptor at not less than 100 mm/sec.

4. An electrophotographic copying process according to claim 1, wherein said electrophotographic photoreceptor is cylindrical or endless belt-like.

5. An electrophotographic copying process according to claim 1, wherein charging is contact-type charging or non-contact-type charging.

6. An electrophotographic copying process according to claim 1, wherein in the step of charge erasure by light, light is applied at an intensity which is 2 to 30 times necessary for reducing by half the potential after charging of the photoreceptor used.

7. An electrophotographic copying process according to claim 1, wherein said phthalocyanine compound is at least one compound selected from the group consisting of non-metallic phthalocyanines and phthalocyanines coordinated with a metal, a metal oxide or a metal chloride.

8. An electrophotographic copying process according to claim 7, wherein said phthalocyanine compound is at least one compound selected from the group consisting of non-metallic phthalocyanines and phthalocyanines coordinated with copper, indium chloride, gallium chloride, tin, titanyl, zinc or vanadium.

9. An electrophotographic copying process according to claim 8, wherein said phthalocyanine compound is non-metallic phthalocyanine or titanylphthalocyanine.

* * * * *